US008008603B2

(12) United States Patent
MacKenzie

(10) Patent No.: US 8,008,603 B2
(45) Date of Patent: Aug. 30, 2011

(54) BOILER PROTECTION APPARATUS AND METHOD

(76) Inventor: Bruce G. MacKenzie, Rye, NY (US)

( * ) Notice: Subject to any disclaimer, the term of this patent is extended or adjusted under 35 U.S.C. 154(b) by 1033 days.

(21) Appl. No.: 11/849,004

(22) Filed: Aug. 31, 2007

(65) Prior Publication Data

US 2009/0056649 A1 Mar. 5, 2009

(51) Int. Cl.
*H05B 1/02* (2006.01)

(52) U.S. Cl. ..... 219/490; 219/506; 219/481; 219/508; 392/450; 392/454; 122/13.01

(58) Field of Classification Search ..... 219/481, 219/483–487, 494, 497, 506, 505, 491, 508–510; 392/441, 463, 454, 478; 307/129; 122/13.01
See application file for complete search history.

(56) References Cited

U.S. PATENT DOCUMENTS 3,865,053 A * 2/1975 Kolze et al. ..... 110/186
4,557,252 A 12/1985 Dinh
4,627,483 A 12/1986 Harshbarger, III et al.
4,639,718 A 1/1987 Gasper
4,662,390 A 5/1987 Hawkins
4,852,046 A 7/1989 Jones et al.
4,872,828 A 10/1989 Mierzwinski et al.
4,941,435 A 7/1990 Person
5,039,006 A 8/1991 Habegger
5,053,978 A 10/1991 Solomon
5,240,179 A 8/1993 Drinkwater
5,444,360 A 8/1995 Drinkwater
5,735,291 A 4/1998 Kaonohi
5,913,236 A 6/1999 Wodeslavsky
6,263,974 B1 7/2001 Sundholm
6,294,765 B1 * 9/2001 Brenn ..... 219/494
6,466,132 B1 10/2002 Caronna et al.
6,533,186 B2 3/2003 Neve et al.
6,622,930 B2 9/2003 Laing et al.
6,728,600 B1 * 4/2004 Contaldo et al. ..... 700/274
6,763,845 B2 7/2004 Hoggard
7,212,562 B2 5/2007 Lai Wai Ma
7,218,237 B2 5/2007 Kates
7,242,114 B1 * 7/2007 Cannon et al. ..... 307/129
(Continued)

*Primary Examiner* — Mark Paschall
(74) *Attorney, Agent, or Firm* — Eric L. Lane; Luce, Forward, Hamilton & Scripps LLP

(57) ABSTRACT

Apparatus and methods for protecting a boiler and heating system from damage comprising a control board having inputs and outputs, a processor having inputs and outputs, at least one ambient sensor in communication with the processor, at least one boiler sensor in communication with the processor, a power failure relay, the power failure relay being in communication with the processor wherein the power failure relay is capable of detecting power failure of the boiler, an alarm relay connected to the control board by the at least one output and which is capable of sending notification to an alarm system. When an ambient temperature detection event occurs the ambient sensor communicates with the processor and switches the control board from passive mode to monitoring mode. When a temperature detection event or a heating system malfunction occurs the boiler sensor or power failure relay or other types of sensors communicate with the processor and initiate an alarm pathway or provide a circulation mode for circulating water through a heating system of an enclosure to be heated by the boiler and heating system. The control board may provide for the boiler to return to normal function when the temperature detection event or the heating system malfunction ends. The apparatus may also be used to prevent boiler, heating system and enclosure damage by initiating other actions when a heating system malfunction occurs.

25 Claims, 4 Drawing Sheets

U.S. PATENT DOCUMENTS

| | | | | |
|---|---|---|---|---|
| 7,243,050 | B2 | 7/2007 | Armstrong | |
| 2005/0098643 | A1* | 5/2005 | Guyer | 237/12.1 |
| 2005/0147402 | A1* | 7/2005 | Baxter | 392/454 |
| 2006/0267756 | A1* | 11/2006 | Kates | 340/521 |
| 2007/0183758 | A1* | 8/2007 | Bradenbaugh | 392/478 |
| 2010/0162741 | A1* | 7/2010 | Friday et al. | 62/178 |

* cited by examiner

BOILER PROTECTION APPARATUS AND METHOD

FIELD OF THE INVENTION

The present invention relates generally to the field of boiler and heating system protection and control.

BRIEF DESCRIPTION OF THE DRAWINGS

In the drawings, which constitute a part of this specification, exemplary embodiments are set forth.

DETAILED DESCRIPTION

Figure 1:
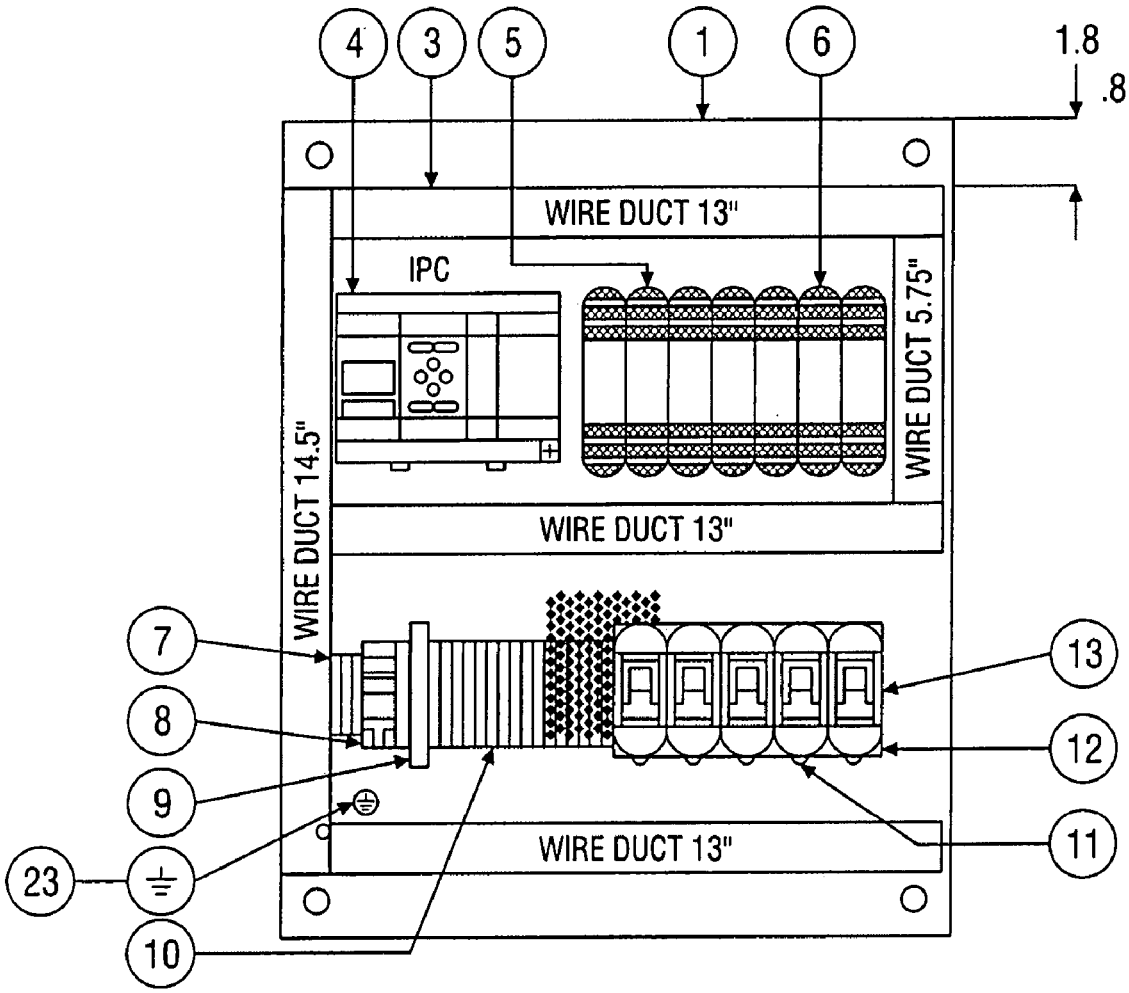
FIG. 1 shows a drawing of the inside of a control board used in some embodiments.
Figure 2:
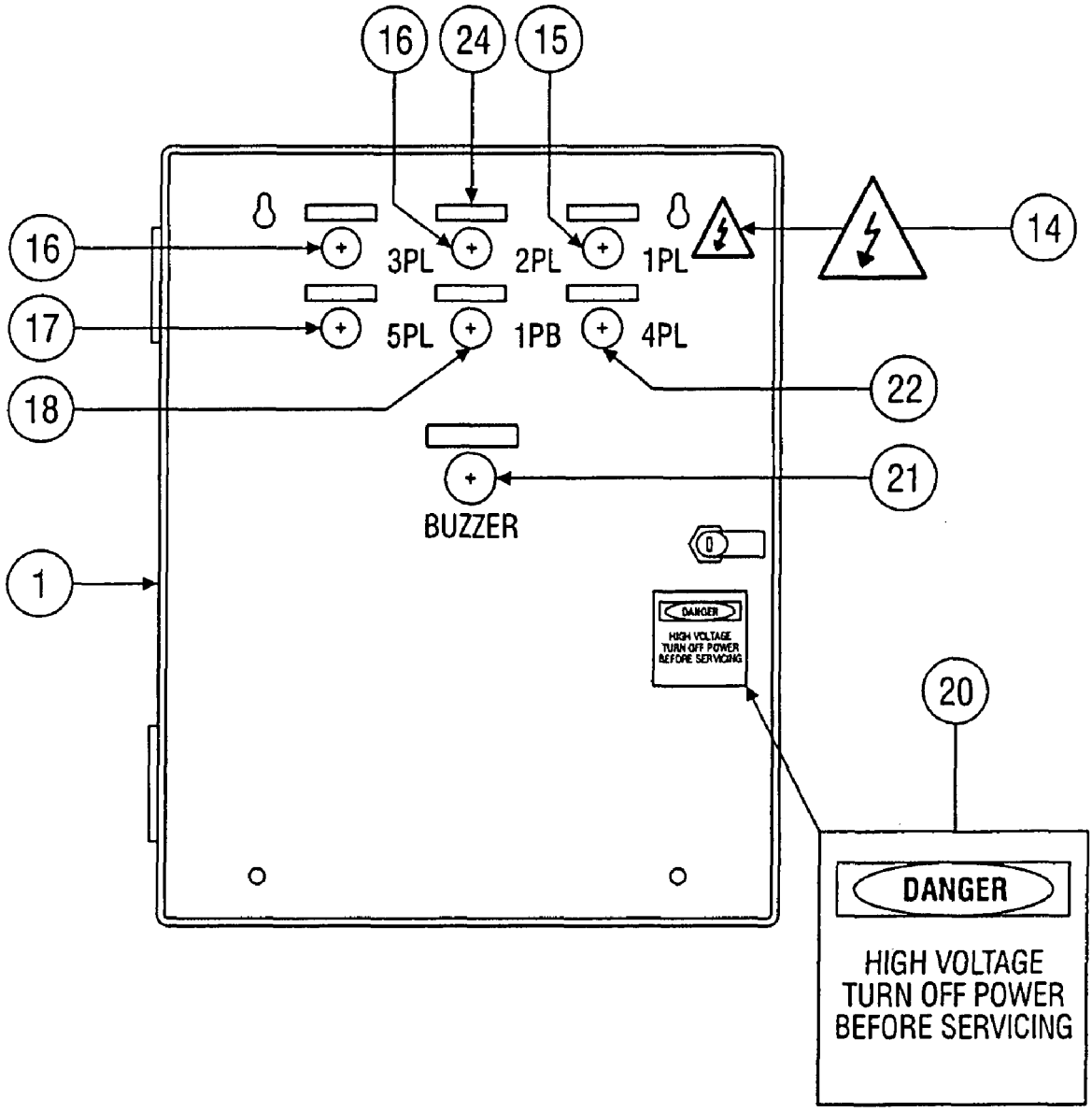
FIG. 2 shows a drawing of the external connections of a control board used in some embodiments.

In the following description, it is to be understood that the terms used have their ordinary and accustomed meanings in the art, unless otherwise specified. The foregoing description discusses some representative embodiments and is not limiting. Other functions and embodiments will be apparent to those skilled in the art.

Heating systems malfunction and fail for many reasons. These include, e.g., power failure, computer malfunction, high boiler temperature, low boiler temperature, freezing due to low ambient temperature, impeller loss or malfunction, tight bearings or loss of water flow, high or low coil temperature and circulator failure. Repairing or replacing a boiler or furnace can be very expensive. If such problems are discovered immediately, damage to the boiler or heating system and the cost of repair can be minimized or even eliminated altogether. Devices and systems exist to detect or prevent specific causes of boiler malfunction. However, there is no system designed to protect against the wide variety of causes of boiler malfunction or failure. To protect against boiler malfunction for all such causes, one would need to employ many different individual protection systems.

An embodiment provides apparatus and methods for protecting boilers and associated heating systems and preventing damage to the boilers and heating system equipment. A boiler is any unit that generates heat as part of a heating system, and could include a furnace or a steam boiler. A heating system may include a boiler and other components, including but not limited to, water pipes, blowers, circulators, motors, etc. Embodiments can be used to prevent boiler, heating system and enclosure damage by initiating certain actions when a temperature detection event or an ambient temperature detection event occurs. A temperature detection event can include high or low temperature in the boiler or high or low temperature associated with one of the components of the boiler or heating system. An ambient temperature detection event can include high or low temperature in an area of the heating system or associated with one or more of the components of the heating system. An ambient temperature detection event can also include low temperature outside the enclosure to be heated by the boiler or low temperature in a heating zone of the enclosure. A heating zone can be any place in the enclosure to be heated where there is a loop of hot water running through a space. An enclosure can be any structure that separates one space from another space and can include but is not limited to a building, house, factory, office building, room, corridor, etc. More detailed descriptions of temperature detection events are discussed herein. They include, but are not limited to high boiler temperature, low boiler temperature, low ambient temperature outside the enclosure to be heated or in a heating zone of the enclosure and high or low coil temperature.

Embodiments protect the boiler and heating system from damage to due to extreme temperatures, e.g., low temperatures below freezing or high temperature above the top threshold temperature a boiler can withstand. Such temperatures are known to those skilled in the art. The temperature of a hot water boiler should be kept below about 250 degrees Fahrenheit, and the temperature of a steam boiler should be kept below about 212 degrees Fahrenheit. Low temperatures can cause cold water shock to a boiler. Cold water shock is damage to the boiler caused by cold water returning to the boiler from a heating zone and hitting the hot boiler surfaces. Cold water shock can cause cracking of boiler sections. Other potential damage includes, but is not limited to cracked pipes in heating zones, flooding due to boiler section cracking and fires due to overheating of the boiler.

Another embodiment can be used to prevent boiler, heating system and building damage by initiating certain actions when a heating system malfunction occurs. Heating system malfunction broadly includes, but is not limited to boiler or heating system malfunction or failure such as impeller loss or malfunction, tight bearings or loss of water flow and circulator failure. When a temperature detection event occurs or a heating system malfunction or failure occurs, embodiments initiate certain actions to notify the owner of the enclosure to be heated or prevent damage to the boiler and heating system. In some embodiments, these actions include but are not limited to alarm notification, circulating water through the heating system and restoring power from an alternative power source.

Figure 3:
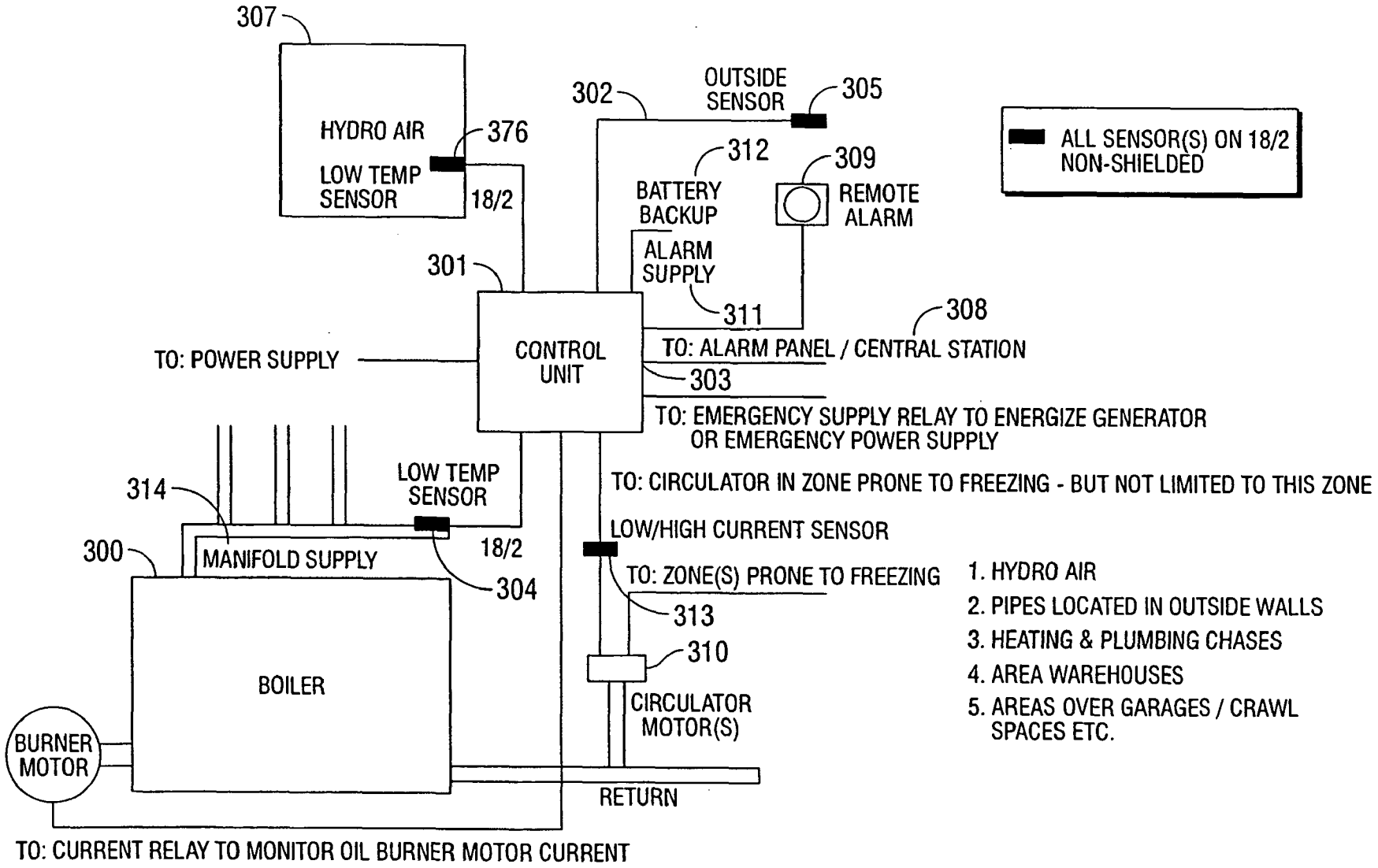
FIG. 3 shows a drawing of an apparatus as arranged in some embodiments discussed herein.
Figure 4:
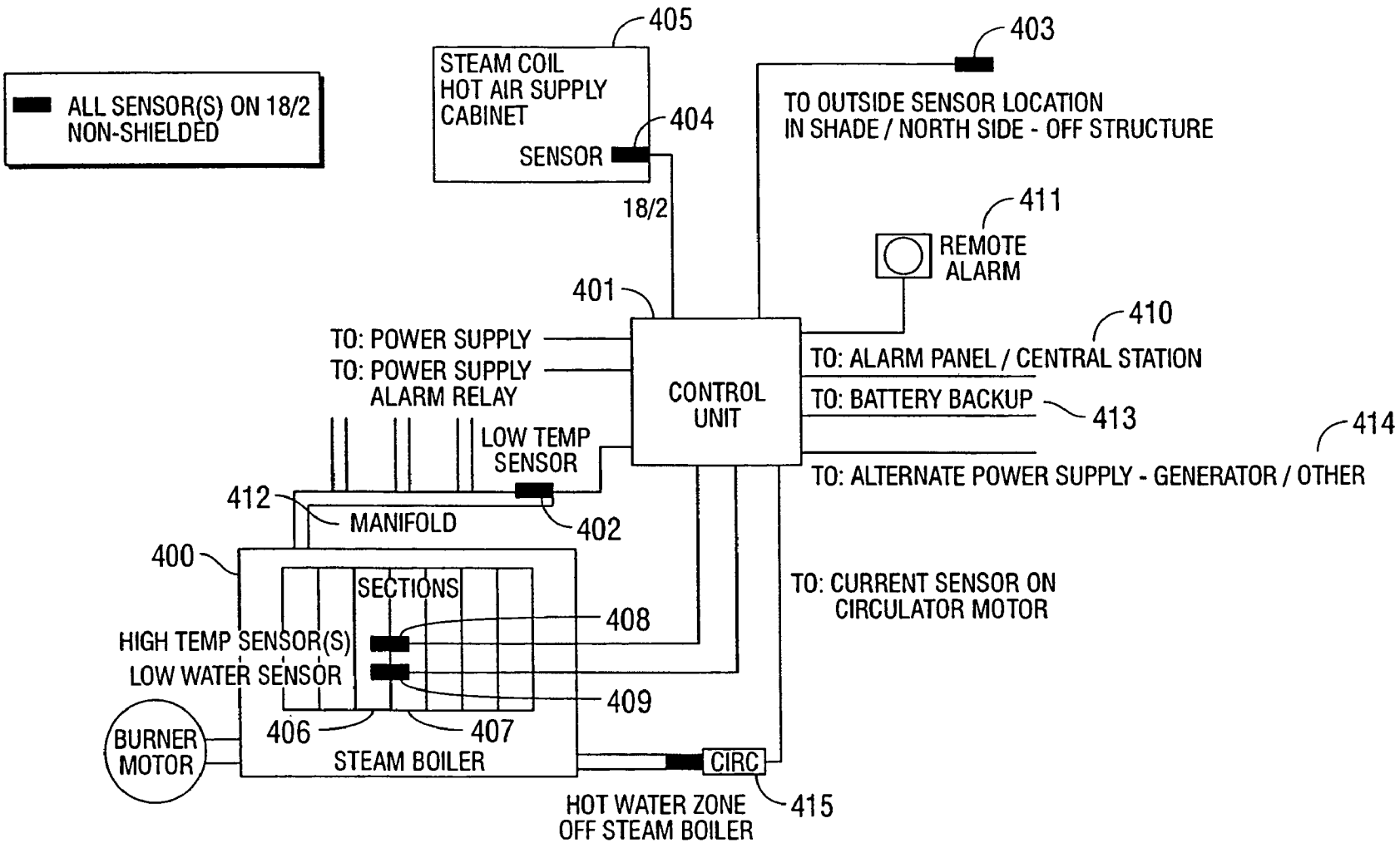
FIG. 4 shows a drawing of an apparatus as arranged in an embodiment including a steam boiler.

Embodiments include various components, which are shown in FIGS. 1-4. The major components include but are not limited to a control board 1, shown in FIGS. 1 and 2 and 301 and 401 shown in FIGS. 3 and 4, a processor 4 shown in FIG. 1, at least one sensor (which could be a temperature sensor, a water flow or water circulation mode sensor, a current sensor, e.g., overcurrent/undercurrent sensor, or a hydro-air sensor) e.g., 304, 305, 306, 313 as shown in FIG. 3 and 402, 403, 404, 408, 409 as shown in FIG. 4, a power relay 12 shown in FIG. 1 and an alarm relay 13 shown in FIG. 1. Other components shown in FIG. 1 include a current relay 5, which measures current and transfers current to the processor, a temperature relay 6, through which the sensors may be hooked up, relay sockets 11 which the relays plug into and 4-pole relays 12 and 13. In some embodiments, as shown in FIG. 1, the processor 4 and relays 5, 6, 12, 13 are contained in the control board 1. FIG. 1 shows the inside of the control board 1 as shown in FIGS. 3 and 4 at 301 and 401 in relation to other components of embodiments of the apparatus. As discussed in more detail herein, an ambient temperature detection event may turn the control board from a stand-by position to a monitoring position.

An embodiment of the boiler protection apparatus is shown in FIG. 3. An embodiment with a steam boiler is shown in FIG. 4. The embodiment in FIG. 3 includes a boiler 300, a control board 301 having at least one input 302 which is in the form of voltage coming in to the processor from the sensors and at least one output 303 which can include alarm signals. As discussed in more detail herein, input comes in from the boiler sensor or sensors 304 as shown in FIG. 3 and 402 as shown in FIG. 4 at the manifold of the boiler, and 408, 409 as shown in FIG. 4 installed between steam boiler section or sections (shown in FIG. 4, reference numbers 406 and 407) or the ambient sensors 305 located outside the enclosure to be heated or in a heating zone of the enclosure. As discussed in more detail herein, there may be a hydro air sensor 306 located in the hydro air blower cabinet 307. The control board comprises a processor, shown in FIG. 1 at 4, which may comprise a single central processing unit (CPU) or multiple processors. The processor executes computer program instructions in the form of software modules programmed to facilitate the monitoring and control functions described herein. The computer program instructions executed by the processor are stored in the processor memory and accessed by the processor as necessary. The control board further comprises a database memory accessible by the processor for storing pertinent information such as temperature ranges. The database may also contain historical and analytical data received by the control board during operation of its monitoring and control functions. The control board further comprises, or has associated therewith, a user interface for allowing a furnace operator to interface with the control board. The user interface may be any form of standard user interface equipment, including, for example, one or more displays, a keyboard and a cursor positioning device, such as a mouse. Further, the user interface may comprise a network connection for distributed interfacing to the control board from a number of computer terminals connected to the network.

The control board monitors the boiler temperature at the sections when the water runs out or evaporates and when the temperature rises above or below normal preset temperature, and some embodiments will trigger signals that ultimately lead the boiler alarm to sound and shut off the boiler. In an embodiment, the control board contains relays 12 and 13, shown in FIG. 1, to shut off the boiler and initiate an alarm pathway to a central alarm 308, 409 or a remote alarm 309, 411. The control board can include a timer and may also contain an alarm supply 311 and battery backup 312. The control board 301, 401 will lock out for steam boilers by reversing the monitoring relay function. The control board is part of the cabinet, which houses relays 12 and 13 shown in FIG. 1, including alarm relays, mounted on a dim rail and may be connected in series parallel with existing circulator relays through a 12-volt coil, four-pole and/or three-pole double throw relays. As shown in FIG. 1, the alarm relays also may be connected to the control board plugged in on a rail with power coming in through terminal blocks 10. Such relay and sensor connections to the control board and processor can also be enabled by other mechanisms known to those of skill in the art, including by wireless technology. In the event the control board fails, e.g., due to low battery or computer malfunction, the relays will drop out and return to normal boiler function. This will be done by reprogramming the processor and installing a reset button on the control board. On commercial boilers a key lock switch can be installed so that only authorized personnel can reset.

Embodiments also include a processor 4 shown in FIG. 1. The processor in some embodiments will be a ZEN Controller. A ZEN Controller can be used in place of using multiple discrete controls such as relays, timers and counters. In some embodiments, multiple relays, timers and counters may be used instead of a ZEN Controller. The ZEN Controller allows the programmable circuit changes. The ZEN Controller may have an 8-digit counter and an 8-digit comparator, and may include a high speed counter (150-Hz) in addition to standard counters. Some embodiments may use a ZEN Controller with twin-timer operation, which is advantageous in that it allows the user to simplify intermittent operation by setting ON and OFF times separately. The appropriate ambient and boiler temperature ranges are programmed into the processor so embodiments respond to ambient temperature detection events and temperature detection events, as described in more detail herein. The processor can also be programmed with information such as current or voltage levels so embodiments can prevent damage due to heating system malfunction, as described in more detail herein. The processor also provides the circulation mode for circulating water via the circulator motors 310. In some embodiments, the processor 4 is located in the control board 1 as shown in FIG. 1, but in other configurations it may be appropriate for the processor to be in a different location outside of the control board.

Embodiments may include one or more sensors. The sensors may be temperature sensors and, in particular, high or low temperature sensors 304, 402, 408. In some embodiments, the temperature sensors are type J sensors. Type J sensors produce a signal on the order of millivolts. The sensors may also be water flow or water level sensors 409. These sensors may be vane type sensors inserted in the normal water in which water pushes against the vane to operate the sensor. In one embodiment, the sensor unit includes a water level sensor 409 and and/or a water temperature sensor 408. The sensors may be installed between boiler section or sections 406, 407. The processor 4 as shown in FIG. 1 processes signals sent by the sensor or sensors and sends signals to relays 12, 13, of which 12 is a power failure relay and 13 is an alarm relay. The sensors may be located in the control board 1 as shown in FIG. 1 or in various locations in or attached to or within the boiler 300, 400, throughout the heating system or outside the enclosure to be heated as appropriate. Sensors in or attached to the boiler will be referred to as boiler sensors. In some embodiments, the boiler sensor will be located on the manifold 314, 412 of the boiler, which is sometimes at the very bottom of the boiler. The sensors may be ambient sensors 305, 403 to monitor temperature of the ambient environment, e.g., an indoor heating zone of the enclosure to be heated or the environment outside the enclosure to be heated.

Such sensors are commercially available, such as the PASPORT™ PS2124 temperature, humidity, and dewpoint sensor, sold by Pasco (www.pasco.com). This unit contains the components necessary to transmit data to a receiver, using radiofrequency (RF) signals, using a Pasco system called XPLORER DATALOGGER™. Various other types of sensors can alternately or additionally be used, if desired, for other types of work. Temperature and humidity sensors (and other types of sensors) that have RF signal-transmitting capability include and utilize a "unique address" system, most commonly a system known as the "MAC" address system. These devices and protocols are well known, and can interact with receiver and/or transmitter systems that are available from companies such as Radiotronix (www.radiotronix.com). These "unique address" systems allow a central unit to identify and correlate each "data set" that is received from any sensor as being from a certain specific sensor, regardless of how many sensors may be active at or near the place of operation.

A second type of sensor may be provided as part of a sensor-switch, which will provide means for determining whether a certain fan, blower, dehumidifier, or other piece of equipment is running, or turned off. This can be done by: (1) plugging a sensor device that contains a current meter (a device that measures electrical current, usually expressed as watts and abbreviated as I) into a wall outlet, extension cord, power strip, or other outlet that will provide 110 or 220 volt alternating current; and, (2) plugging a fan, dehumidifier, or other power equipment into an outlet that is provided and controlled by the sensor-switch 500. If and when a fan, dehumidifier, or other device is turned on and running, the current that powers the device must flow through the sensor-switch, allowing it to measure the current. Accordingly, each sensor-switch can indicate whether a certain piece of equipment is running, or not running. In addition, if a current load becomes unusually high (which indicates that a problem may have arisen or may be approaching), a sensor-switch can trigger an alert or alarm signal, which can activate a pre-programmed response (such as, for example, turning off the power equipment to prevent possible damage, sending an alarm signal to a remote computer or pager, and activating one or more camera or video devices that will begin recording and storing pictures of the job site, to allow a contractor to use a remote computer to see what is happening at the job site). In addition, sensor-switch devices may be provided with on/off switching capability that can be controlled by processor.

The control board 301, 401 receives sensor data from the sensor(s). Some sensors produce digital data. However, for many types of sensors, the sensor data is analog data. Analog sensor data may be converted to digital format by the control board. In one embodiment, the control board evaluates the data received from the sensor(s) and determines whether the data is to be transmitted to the base unit. The sensor unit generally conserves power by not transmitting data that falls within a normal range. In one embodiment, the control board evaluates the sensor data by comparing the data value to a threshold value (e.g., a high threshold, a low threshold, or a high-low threshold). If the data is outside the threshold (e.g., above a high threshold, below a low threshold, outside an inner range threshold, or inside an outer range threshold), then the data is deemed to be anomalous and the control board causes some of the functions described herein. In some embodiments, the data threshold is programmed into the control board.

In an embodiment, shown primarily in FIG. 3, with the control board interior details shown in FIG. 1, the components are connected as follows: the processor 4 is located within the control board cabinet 1, 301, 401 and is in communication with the control board. A sensor is attached to a boiler in the section, this boiler sensor 304 being in communication with the control board 1, 301, 401 and the processor 4 therein through the processor's at least one input. The boiler sensor 304 is capable of communicating with the processor 4. A single processor can interact with multiple sensors and sensor-switches, by means of an on-site router or hub device, or by means of a wireless network. Regardless of whether a hard-wired or wireless system is used, the software that is used to run the boiler protection apparatus can be programmed to cause the processor to initiate any type of desired routine, when the processor detects signals from one or more sensors through conductors between the sensor and the processor. In some embodiments, there is an additional sensor or sensors in communication with the processor through the at least one input. The additional sensor may be an ambient sensor 305 located outside the structure to be heated or in a heating zone of the structure. Ambient sensors may be located in any area known to those of skill in the art to be prone to freezing, such as, e.g., hydro air cabinet, pipes located in outside walls, heating and plumbing chases, area warehouses, areas over garages, attics, basements, crawl spaces, etc. The ambient sensor is also capable of communicating with the processor through a control cable to the second input of the control board through conductors between the sensor and the processor.

In some embodiments, the apparatus includes a power failure relay 12, shown in FIG. 1, which may be located in the control board 1 and is capable of detecting boiler power failure. The power failure relay may be a 120-volt relay, but other voltages may be used. When power loss occurs, the relay drops out and contacts close, indicating a voltage flow from the remote alarm panel to initiate an alarm pathway. In particular, in some embodiments, when the coil of the relay is de-energized, the contacts close and send a signal to an alarm panel or a monitored panel to trigger an alarm or engage an alternate power supply. Some embodiments include a 12-volt DC battery backup power supply. In some embodiments, the power failure relay is attached to the boiler, but it may be located in other parts of the heating system as appropriate. The apparatus may also include an alarm relay 13, shown in FIG. 1. These relays may be located in the control board 1, but other locations may be appropriate depending on the needs of the user. In some embodiments, the relays may be pin type relays with matching sockets. These relays may operate on a 12-volt DC supply and a 110-volt AC supply, but other voltages may be used. If additional motors are used, additional transformers would be required and voltages and current measurements may change. The alarm relay 13 is connected to the control board 1 by the control board's contacts. The alarm relay is capable of sending notification to an alarm system. The alarm system could be a local alarm in the building to be heated by the boiler or an off site alarm center. In some embodiments, three phase circulator motors will be monitored by a separate CT transformer located in the circulator relay and brought back to the master control by an 18-gauge shielded conductor, passing through to an interior terminal block 10 connected to the control board 1 connected to processor input terminals, shown generally in FIG. 2. Power failure relays 12 may be located in the control board 1, but may be situated in various locations in the boiler or throughout the heating system as appropriate.

Temperature monitoring relays may also be used in some embodiments. These facilitate the monitoring of excessive or abnormal temperatures outside the predetermined safe temperature ranges for a boiler or heating system. The user can select function settings using a DIP switch. Some such relays have LED indicators to show alarm status. To monitor for overcurrent or undercurrent, a single-phase current relay, shown in FIG. 1 at 5, may be used. This type of relay allows manual resetting and automatic resetting. In some embodiments, the temperature monitoring relays, shown in FIG. 1 at 6 are located in the control board 1, but they may be located in various places in the boiler or throughout the heating system as appropriate.

In some embodiments, the boiler protection apparatus prevents damage to the boiler, the heating system and the structure to be heated by the boiler from freezing water due to cold weather by detecting an ambient temperature detection event and sending an alarm notification as discussed herein. In such an embodiment, the ambient sensor 305, 403 is a temperature sensor located outside the building to be heated by the boiler, and a boiler sensor 304, 402 may be attached to the boiler or boiler sensors 408, 409 may be located within the boiler sections 406, 407. The sensors communicate with the processor by way of a 2-wire control when the temperature of the boiler deviates from a predetermined temperature range. The user uses the control board 1, 301, 401 to program into the processor 4 the desired temperature range to prevent freezing. For example, if boiler temperature drops below 40 degrees Fahrenheit, the boiler sensor 304, 402 will send a signal to the processor 4. The temperature could also be set higher at e.g., 50 degrees Fahrenheit, or other temperatures as deemed appropriate by the user. If the boiler is a steam boiler, the boiler sensor 408, 409 may be located in the jacket of the steam boiler or in the water of the steam boiler 400.

In addition, the ambient sensor 305, 403 responds and communicates with the processor 4 within the control board 1, 301, 401 when the outside temperature drops below a predetermined temperature. That temperature would be selected from a range preferably between about 33 degrees Fahrenheit and about 40 degrees Fahrenheit, but could be above 40 degrees Fahrenheit or below 33 degrees Fahrenheit if desired. A temperature should be selected so the ambient sensor responds before the temperature drops low enough to cause the water in the heating system to freeze. This temperature can be adjusted. The sensors are also programmed to respond and signal to the processor when the differential between the boiler temperature and the outside temperature expands beyond a predetermined differential. In some embodiments, the differential may be plus or minus 5 degrees Fahrenheit, but it may vary based on the needs of the user.

Thus, when the outside temperature gets close to freezing and drops below the predetermined temperature programmed into the processor, the ambient sensor 305, 403 communicates the outside temperature to the processor 4. Ambient sensors located in a heating zone can also initiate an alarm if ambient temperature or boiler temperature is too low. Such signals from an ambient sensor turn the control board 1, 301, 401 from a passive mode to a monitoring mode. Passive mode is essentially a stand-by position, which includes monitoring of boiler temperature, but does not include monitoring of circulator function or hydro air temperature. When the control board 1, 301, 401 is in this monitoring mode, the processor 4 then signals the current sensor 313 to monitor the circulators and a hydro air sensor 306, 404 to monitor the hydro air in the hydro air or hot air cabinet 307, 405. In other words, the switch to monitoring mode will automatically bring in signals from the current sensors and hydro air sensors. If the boiler temperature or heating zone temperature deviates from the predetermined temperature programmed into the processor, the boiler sensor communicates to the processor. Furthermore, if the differential between the boiler temperature and the outside temperature exceeds the predetermined differential programmed, the sensors communicate with the processor. When the processor 4 receives the signal from the sensor, the processor signals the alarm relay 13, which sends an alarm notification to an alarm system 308, 410. Specifically, the processor 4 operates the alarm relay 13 located in the control board 1, 301, 401 to send an alarm notification to a central alarm 308, 410 or local/remote alarm 309, 411 by way of an alarm panel monitored by a central alarm station. This sequence of signals from the processor/control board to the alarm relay to an alarm system shall be referred to herein as the alarm pathway. Signals from a sensor or sensors to the processor feed into the alarm pathway. Also, as discussed in more detail herein, signals from a power failure relay can feed into the alarm pathway. The control board provides for the boiler to return to normal function when the outside temperature returns to a temperature above the predetermined temperature, e.g., in some cases above 40 degrees Fahrenheit. Specifically, when the ambient sensor sends a signal to the processor, the processor returns the boiler to normal function, which is known to those skilled in the art and includes operating without any alarm or alternate power and regular circulation of water when the enclosure needs to be heated. The processor may also return the boiler to high temperature or low water alarm only.

In other embodiments, the boiler protection apparatus prevents damage to the boiler and the enclosure to be heated by the boiler from damage due to cold temperatures by operating to circulate water through the heating system during a temperature detection event such as cold weather. In such an embodiment, the ambient sensor 305, 403 is a temperature sensor located outside the enclosure to be heated by the boiler. To perform this function, there is a boiler sensor 304, 402, 408 attached to the boiler or within the boiler and programmed to respond and communicate with the processor when the temperature of the boiler deviates from a predetermined temperature range. For example, the acceptable temperature range might be 33 degrees Fahrenheit to 40 degrees Fahrenheit. In addition, the ambient sensor is programmed to respond and communicate with the processor when the outside temperature drops below a predetermined temperature. That temperature would be selected from a range preferably between about 33 degrees Fahrenheit and about 40 degrees Fahrenheit, but could be above 40 degrees Fahrenheit or below 33 degrees Fahrenheit if desired. A temperature should be selected so the ambient sensor responds before the temperature drops low enough to cause the water in the heating system to freeze. This temperature can be adjusted. The sensors are also programmed to respond and signal to the processor when the boiler temperature and the outside temperature exceed a predetermined differential, see e.g., 408, the high temperature sensor. The differential may be plus or minus 5 degrees Fahrenheit, but may vary based on the needs of the user. The processor is programmed to operate circulation for circulating water. The circulation occurs in a zone or zones prone to freezing according to a predetermined circulation time. In some embodiments, the predetermined circulation time may be in the range of 1 to 5 minutes, but other circulation times may be used. Those skilled in the art will be able to determine appropriate intervals for circulating water.

Thus, when the outside temperature gets close to freezing and drops below the predetermined temperature programmed into the processor, the ambient sensor 305, 403 communicates the outside temperature to the processor 4 in the control board 1, 301, 401, and the control board switches from passive mode to monitoring mode. If the boiler temperature deviates from the predetermined temperature range programmed into the processor, the boiler sensor 304, 402, 408 communicates the boiler temperature to the processor, and the same switch occurs. Furthermore, if the differential between the boiler temperature and the outside temperature exceeds the predetermined differential programmed into the processor, the ambient sensor communicates with the processor. When the processor receives the signal from the sensor, the processor provides the circulation mode for circulating water. An interval timer is part of the processor and is set to turn on or off through a 4-pole double throw relay located in the control board connected to the circulator of the zone. Hot water then circulates through the heating system periodically to prevent freezing damage to the system. The circulation mode can be adjusted to provide circulating water at different time intervals, which may be 1 to 5 minutes or other time intervals known to those skilled in the art. When the temperature detection event ends, i.e., the ambient temperature rises above the predetermined low temperature range or drops below the predetermined high temperature, the processor provides for the zone to return to normal function. Specifically, when the ambient sensor sends a signal to the processor, the processor returns the boiler to normal function, which is known to those skilled in the art and includes operating without any alarm or alternate power and regular circulation of water when the enclosure needs to be heated. The processor may also return the boiler to high temperature or low water alarm only. Normal function specifically includes routine water circulation, i.e., circulation switches back to normal operation consistent with the room thermostat.

In another embodiment in which the apparatus prevents freezing damage, the ambient sensor could be located in a heating zone of a building to be heated by the boiler. The ambient sensor is programmed to respond and communicate with the processor when the ambient temperature of the heating zone drops below a predetermined temperature. That temperature would be selected from a range preferably between about 33 degrees Fahrenheit and about 40 degrees Fahrenheit, but could be above 40 degrees Fahrenheit or below 33 degrees Fahrenheit if desired. A temperature should be selected so the ambient sensor responds before the temperature drops low enough to cause the water in the heating system to freeze. The sensors also may be programmed to respond and signal to the processor when the differential between the boiler temperature and the outside temperature exceeds a predetermined differential. The differential may be plus or minus 5 degrees Fahrenheit, but may vary based on the needs of the user. In this embodiment, the processor can signal the alarm relay to send an alarm notification or the processor can provide circulation mode for circulating water through the heating zone.

In another embodiment in which the apparatus prevents freezing damage by responding to a temperature detection event, the apparatus functions with only a sensor attached to or within a boiler. The user programs the processor or control board so the boiler sensor 304, 402, 408 responds and communicates with the processor when the temperature of the boiler deviates from a predetermined temperature range. If the boiler temperature deviates from the predetermined temperature range programmed into the processor, the boiler sensor communicates the boiler temperature to the processor. When the processor receives the signal from the sensor, the processor initiates an alarm pathway.

It should be noted that, in some embodiments, the boiler sensor will constantly monitor for and respond to a temperature detection event. In these embodiments, the boiler sensor activity will occur even without a signal from the ambient sensor in response to an ambient temperature detection event. However, the switch from passive mode to monitoring mode caused by the signal from the ambient sensor can cause the control board and processor to start monitoring for certain heating system malfunctions, as explained in more detail herein.

An embodiment may have a third sensor that can also be a water flow or low water detector 409. In this embodiment, the apparatus can detect heating system malfunction by determining that the water level is low either in the boiler or in a heating zone. The third sensor is programmed to respond and send a signal to the processor if the water level in the boiler is low, the water level overheats due to high limit failure, or there is a heating zone water flow below a predetermined level. Most boilers have a low water shut off triggered by low water level. However, low water shut off in a boiler doesn't always work, and in an embodiment, the low water shut off is based on the temperature of sections 406, 407 of the boiler. Thus, if the temperature is too high because the boiler water drops below a pre-determined level, the water sensor communicates the boiler low water level to the processor. When the processor receives the signal from the sensor, the processor initiates an alarm pathway. As such, the owner or occupant of the enclosure to be heated by the boiler can take appropriate action to prevent further damage to the boiler.

In another embodiment, the boiler protection apparatus sounds an alarm in the event of power failure to the boiler. Control board 301, 401 is attached to the boiler power supply. The power failure relay may be attached to the boiler or located within the control board. In some embodiments, the power failure relay, shown in FIG. 1 at 12, consists of a 120-volt coil. When the power failure relay detects power failure of the boiler, the power failure relay drops out and contacts close, so a signal will be sent to the processor. The communication from the power failure relay will be sent to the processor to initiate an alarm pathway. As such, the owner or occupant of the building to be heated by the boiler can take appropriate action to prevent further damage to the boiler.

An embodiment can also detect circulator failure by determining whether the boiler circulator is drawing too much or too little current (See FIG. 3), or when bearings are too tight, the motor fails or when there is coupling between the motor and the pump fails or there is impeller loss. The appropriate current level varies depending on the size of the circulator motor 310. A person of ordinary skill in the art would set the appropriate current level based on the size of the motor, and if the level is too high or too low, a sensor will send a signal to the processor. This function can be performed by employing an overcurrent/undercurrent sensor 313, which monitors the current being drawn through the current transformers of the burner motor or motors 310. Alternatively, if the boiler is a motor-fired boiler, the overcurrent or undercurrent may be detected by monitoring motor bearing function by current induction.

The overcurrent/undercurrent sensor may be connected to the hydro-air blower motor to monitor motor current and is programmed to respond and send a signal to the processor if it detects that the burner motor is drawing too much or too little current which deviates from a predetermined current draw set to motor FLA (full load amperage). Such deviation can indicate motor failure due to tight bearings, loss of drive belt or shaft shear. Thus, if the current draw deviates from the level programmed into the overcurrent/undercurrent sensor, the overcurrent/undercurrent sensor communicates with the processor, which signal may travel via a current relay in FIG. 1 at 5, initiating an alarm pathway. As such, the owner or occupant of the building to be heated by the boiler can take appropriate action to prevent further damage to the boiler, e.g., replace the circulators or drive belt or adjust the bearings. It should also be noted that circulator bearing failure can be detected by monitoring current to circulator in the same fashion.

An alternative embodiment, also shown in FIG. 3, can detect circulator failure by a hydro air sensor. The hydro air temperature sensor 306 may be located in a hydro air blower cabinet 307. The hydro air sensor is programmed to respond and send a signal to the processor if it detects a temperature deviation. Thus, if the hydro air sensor detects that the temperature has deviated from the predetermined temperature, the hydro air sensor communicates with the processor, which signal may travel via a current relay in FIG. 1 at 5. When the processor receives the signal from the hydro air sensor, the processor communicates with the circulator relay and blower motor, which sends a signal to turn the circulator on to circulate water for a predetermined time, which may be 1 to 5 minutes and must turn on the blower motor. It also may initiate an alarm pathway. As such, the owner or occupant of the building to be heated by the boiler can take appropriate action to prevent further damage to the boiler, e.g., replace the circulators.

Another embodiment can detect circulator failure by determining loss of circulator impeller, which is essentially a turbine that causes water flow. In this embodiment a hydro air sensor 306, 404 detects loss of a circulator impeller and initiates an alarm pathway. As such, the owner or occupant of the building to be heated by the boiler can have the impeller repaired or replaced immediately to prevent further damage to the boiler. In some embodiments, a current sensor may be used to detect undercurrent or a flow sensor may be used to detect when an impeller falls off. The processor may also provide a signal to circulate water through the zone to be heated. Any of the aforementioned embodiments regarding circulator failure can detect zone failure by determining circulator failure. If a person of skill in the art is notified of circulator failure, he can detect failure of a heating zone of the heating system being monitored.

An embodiment of the apparatus can also monitor temperature of the heating coils in the boiler by employing a hydro air sensor. This embodiment is shown in FIG. 3. The hydro air sensor 306, 404 may be located in a steam coil hot air supply cabinet. The hydro air sensor is programmed to respond and send a signal to the processor if it detects heating coil temperature that is too high or too low which deviates from a predetermined temperature range. Thus, if the hydro air sensor detects that the temperature has deviated from the predetermined temperature range, the hydro air sensor initiates an alarm pathway. In addition, if the temperature in the hydro air cabinet stays too low for a predetermined period of time, the hydro air sensor initiates an alarm pathway. As such, the owner or occupant of the enclosure to be heated by the boiler can take appropriate action to prevent further damage to the boiler or heating system.

Various embodiments provide methods of protecting a boiler from damage comprising some of the following functions. The foregoing description discusses some representative embodiments, and is not limiting. Other functions and embodiments will be apparent to those skilled in the art. These include detecting ambient temperature detection events, temperature detection events and heating system malfunction, including but not limited to situations where the temperature of the boiler deviates from a predetermined temperature range, when the temperature of heating coils in the boiler deviates from a predetermined temperature range, when ambient temperature drops below a predetermined temperature range, boiler failure, circulator failure and low water level in the boiler. These methods may be performed by embodiments that utilize components the same as or similar to those described above, including a control board, a processor, relays, sensors, alarms, etc., connected in similar arrangements. These methods will be described in more detail below.

One method of protecting a boiler from damage is to detect boiler failure and provide an alarm notification in the event of failure. This can include detecting power failure to the boiler and restoring power by providing it from an alternative power source. Such alternative power source could include a generator or a battery backup, or other power sources known to those skilled in the art. In some embodiments, boiler failure is detected by monitoring power via a power failure relay 12. The features of the power failure relay are discussed above in more detail, and it may be attached to the boiler 300, 400 and may consist of a 120-volt coil. When the power failure relay 12 detects power failure of the boiler 300, 400, it initiates an alarm pathway. As such, the owner or occupant of the enclosure to be heated by the boiler can take appropriate action to prevent further damage to the boiler. Alternatively, or in addition to initiating an alarm pathway, after the processor 4 communicates with the control board 1, 301, 401, the control board may then restore power to the boiler from an alternative power source, e.g., at battery backup 413. Boiler failure can also be detected by determining computer malfunction where a computer operates the boiler when boiler temperature drops below a predetermined temperature in relation to the outside temperature.

Another method performed by an embodiment is to detect circulator failure by determining whether the circulator is drawing too much or too little current, or when bearings are too tight, the motor fails, or when there is coupling or impeller loss. The appropriate current level varies depending on the size of the circulator motor. A person of ordinary skill in the art would set the appropriate current level based on the size of the motor, and if the level is too high or too low, a sensor will send a signal to the processor. This function can be performed by employing an overcurrent/undercurrent sensor 313, which monitors the current being drawn through the current transformers of the circulator motor or motors 310, 415. Alternatively, if the boiler is a motor-fired boiler, the too much or too little current is detected by monitoring boiler bearing function. When the bearings get too tight, the current level increases. In addition, there may be changes in current level in the burner motor. The overcurrent/undercurrent sensor is programmed to respond and send a signal to the processor if it detects that the circulator is drawing too much or too little current which deviates from a predetermined current draw set to motor FLA (full load amperage).

Thus, in this method, if the current draw deviates from the level programmed into the overcurrent/undercurrent sensor 313, the overcurrent/undercurrent sensor initiates an alarm pathway. As such, the owner or occupant of the enclosure to be heated by the boiler can take appropriate action to prevent further damage to the boiler. It should also be noted that circulator bearing failure can be detected by monitoring current to circulator in the same fashion. Further, an overcurrent or undercurrent sensor can be connected to the processor to detect motor undercurrent or overcurrent such as bearing failure, shaft or burner loss.

An alternative method is to detect circulator failure by a hydro air sensor 306, 404. The hydro air unit may be located in a hydro air blower cabinet 307, 405. The hydro air sensor is programmed to respond and send a signal to the processor if it detects low temperature in the cabinet which deviates from a predetermined air temperature level. Thus, if the hydro air sensor detects that the air flow has deviated from the predetermined air flow level, the hydro air sensor initiates an alarm pathway. As such, the owner or occupant of the enclosure to be heated by the boiler can take appropriate action to prevent further damage to the boiler and heating system.

Another method is to detect circulator failure by determining loss of a circulator impeller and initiate an alarm pathway or to circulate water through the system when there is no water flow or low current. When the hydro air sensor determines loss of a circulator impeller it initiates an alarm pathway. As such, the owner or occupant of the enclosure to be heated by the boiler can have the impeller repaired or replaced immediately to prevent further damage to the boiler. In some embodiments, a current sensor may be used to detect undercurrent or a flow sensor may be used to detect when an impeller falls off.

An embodiment includes a method of protecting a hydro air coil from freezing due to low cabinet temperature or enclosure temperature. A hydro air coil is a cabinet in which air is blown over a radiator or convector. The cabinet may be located near the boiler or in an attic or elsewhere in an enclosure to be heated by the heating system, and the enclosure generally holds the radiator. In an embodiment, this method is done by using an air sensor to detect low temperature in the cabinet. The air sensor may be located in an air blower cabinet. When the sensor detects an ambient temperature detection event in the cabinet or enclosure, it initiates an alarm pathway. As such, the owner or occupant of the enclosure to be heated by the boiler can take appropriate steps to prevent further damage to the boiler and heating system.

Another method of protecting the boiler is to monitor the relay power of heating system circulators through a power relay connected to circulator power supply. Connection to the power supplying another manufacturer's relay or relay board will open power to the alarm relay located in the control board 301, 401. Contacts will close, and the signal from the relay initiates an alarm pathway. As such, the owner or occupant of the enclosure to be heated by the boiler can take appropriate action to prevent further damage to the boiler.

In some embodiments, the method of preventing damage to the boiler and the enclosure to be heated by the boiler is to prevent damage from freezing water due to cold weather by detecting an ambient temperature detection event or a temperature detection event and providing an alarm notification. In such an embodiment, the ambient sensor 305, 403 is a temperature sensor located outside the building to be heated by the boiler. In this method, a sensor is attached to the boiler and is programmed to respond and communicate with the processor when the temperature of the boiler deviates from a predetermined temperature range. In some embodiments the temperature range will be 33 to 40 degrees Fahrenheit, but other temperature ranges may be used. If the boiler is a steam boiler 400, the boiler sensor 408 may be located in the jacket of the steam boiler or in the water of the steam boiler. In addition, the ambient sensor is programmed to respond and communicate with the processor when the outside temperature drops below a predetermined temperature. That temperature would be selected from a range preferably between about 33 degrees Fahrenheit and about 40 degrees Fahrenheit, but could be above 40 degrees Fahrenheit or below 33 degrees Fahrenheit if desired. A temperature should be selected so the ambient sensor responds before the temperature drops low enough to cause the water in the heating system to freeze. The sensors are also programmed to respond and signal to the processor when the differential between the boiler temperature and the outside temperature exceeds a predetermined differential. The differential may be plus or minus 5 degrees Fahrenheit.

Thus, in this method, when there is an ambient temperature detection event such that the outside temperature gets close to freezing and drops below the predetermined temperature programmed into the processor, the ambient sensor 305, 403 communicates the outside temperature to the processor 4. If the boiler temperature deviates from the predetermined temperature range programmed into the processor 4, the boiler sensor 304, 402, 408 communicates the boiler temperature to the processor. Furthermore, if the differential between the boiler temperature and the outside temperature exceeds the predetermined differential programmed into the boiler sensor 304, 402, 408 and ambient sensor 305, the boiler sensor 304, 402, 408 or ambient sensor 305 communicates with the processor 4. The communication may be by voltage fluctuations from the J sensor to the processor. One or more J sensors may be inserted into a section or sections of the boiler. The processor in some embodiments of this method will be a ZEN Controller. When the processor receives the signal from the sensor, the processor in turn communicates with the control board 1, 301, 401, which communicates with the alarm relay 13, which sends an alarm notification to an alarm system 308. Specifically, the processor operates the alarm relay 13 located in the master control board 1, 301, 401 to initiate an alarm pathway. In an embodiment, a set of contacts is connected to a monitoring alarm control panel. When the contacts open, a zone is triggered and a signal is sent by land line or radio to a central station. The control board provides for the boiler to return to normal function when the outside temperature returns to a temperature above the predetermined temperature, e.g., in some cases above 40 degrees Fahrenheit. Specifically, when the ambient sensor sends a signal to the processor, the processor returns the boiler to normal operation. The processor may also return the boiler to high temperature or low water alarm only.

In other embodiments, the method of protecting a boiler from damage is to circulate water through the heating system when an ambient temperature detection event occurs. In such an embodiment, the ambient sensor 305, 403 is a temperature sensor located outside the enclosure to be heated by the boiler. To perform this function, a sensor 304, 402 is attached to the boiler 300, 400 and is programmed to respond and communicate with the processor 4 when the temperature of the boiler deviates from a predetermined temperature range. In some embodiments, the temperature range may be 40 to 50 degrees Fahrenheit, but other temperature ranges may be used. In addition, the ambient sensor 305, 403 is programmed to respond and communicate with the processor 4 when the outside temperature drops below a predetermined temperature. That temperature would be selected from a range preferably between about 33 degrees Fahrenheit and about 40 degrees Fahrenheit, but could be above 40 degrees Fahrenheit or below 33 degrees Fahrenheit if desired. The goal is to select a temperature so the ambient sensor responds before the temperature drops low enough to cause the water in the heating system to freeze. The sensors are also programmed to respond and signal to the processor when the differential between the boiler temperature and the outside temperature exceeds a predetermined differential. Temperature differentials may be 5 to 10 degrees Fahrenheit, but other temperature differentials may be used. In some embodiments, the processor is programmed to operate circulation mode for circulating water. The processor will turn the circulator on for a predetermined period of time, which may be about 1 to about 5 minutes, but other times may be used. Those skilled in the art will be able to determine appropriate intervals for circulating water.

Thus, in this method, when the outside temperature gets close to freezing and drops below the predetermined temperature programmed into the ambient sensor 305, 403, the ambient sensor communicates the outside temperature to the processor 4. Such signals from the ambient sensor turn the control board 1, 301, 401 from a passive mode to a monitoring mode. Passive mode is essentially a stand-by position, which includes monitoring of boiler temperature, but does not include monitoring of circulators or hydro air. When the control board 1, 301, 401 is in this monitoring mode, the processor 4 then signals the boiler sensor 304, 402, 408 or an ambient sensor 305, 403 in a heating zone to monitor the temperature of the boiler or the heating zone or to monitor the circulators and hydro air. In other words, the switch to monitoring mode will automatically bring in signals from the current sensors and hydro air sensors. If the boiler temperature deviates from the predetermined temperature range programmed into the processor, the boiler sensor communicates the boiler temperature to the processor. Furthermore, if the differential between the boiler temperature and the outside temperature exceeds the predetermined differential programmed into the processor, the processor shows circulation function and turns on the circulator for a predetermined time.

In addition, in this method, there is a third boiler sensor, which is a low water sensor 409 which communicates with the processor. When the processor receives the signal from the low water sensor, the processor provides the circulation mode for circulating water through a time interval programmed into the processor. An interval timer is part of the processor set to turn on or off through a 4-pole double throw relay located in the control board connected to the circulator of the zone. Hot water then circulates through the heating system periodically to prevent freezing damage to the system. The circulation mode can be adjusted to provide circulating water at different time intervals known to those skilled in the art. The boiler can also be switched to maintain a 120 degree Fahrenheit temperature during cold weather to prevent shocking the boiler from too low water temperature return differential.

In another embodiment where this method is to prevent freezing damage, the ambient sensor 305, 403 could be located in a heating zone of a building to be heated by the boiler. The ambient sensor 305, 403 is programmed to respond and communicate with the processor 4 when the ambient temperature of the heating zone drops below a predetermined temperature. That temperature would be selected from a range preferably between about 33 degrees Fahrenheit and about 40 degrees Fahrenheit, but could be above 40 degrees Fahrenheit or below 33 degrees Fahrenheit if desired. In this method, a temperature should be selected so the ambient sensor responds before the temperature drops low enough to cause the water in the heating system to freeze. The sensors are also programmed to respond and signal to the processor when the boiler temperature and the outside temperature exceeds a predetermined setting. In some embodiments, the differential may be plus or minus 5 degrees Fahrenheit, but it may vary based on the needs of the user. In this method, the processor 4 can signal the alarm relay 13 to send an alarm notification or the processor can provide circulation mode for circulating water through the heating zone.

In another embodiment in which the method is to prevent freezing damage, there could be only a boiler sensor attached to boiler and no additional sensors. In this method, the boiler sensor 304, 402, 408 is programmed to respond and communicate with the processor when the temperature of the boiler deviates from a predetermined temperature range. If the boiler temperature deviates from the predetermined temperature range programmed into the processor, the boiler sensor initiates an alarm pathway.

In some embodiments, there is a third boiler sensor that can also be a low water flow sensor 409. In such embodiments, the method is to detect possible boiler failure or malfunction by determining that the water level is low either in the boiler or in a heating zone. In this method, the processor 4 is programmed so the third boiler/low water flow sensor 409 will respond and send a signal to the processor if the water level in the boiler or in a heating zone drops below a predetermined level, i.e., when the water level is below the water level sensor. Most boilers have a low water shut off triggered by low water level. However, low water shut off in boiler doesn't always work, and in an embodiment, the low water shut off is based on the temperature of sections of the boiler. Thus, if the temperature is too high because the boiler water drops below a pre-determined level, the third sensor communicates the boiler low water level to the processor, initiating an alarm pathway. As such, the owner or occupant of the building to be heated by the boiler can take appropriate action to prevent further damage to the boiler.

Alternatively, a method of protecting a boiler from damage could include the situation where detection of ambient temperature below a predetermined temperature causes monitoring of boiler temperature. To perform this method, the boiler sensor 304, 402 is attached to the boiler 300, 400. If the boiler is a steam boiler, the boiler sensor 408 may be located in the jacket of the steam boiler or in the water of the steam boiler. There is an ambient temperature sensor 305, 403 located either outside the building to be heated by the boiler or in a heating zone of the building to be heated by the boiler. The ambient sensor is programmed to respond and communicate with the processor 4 when the outside temperature drops below a predetermined temperature. That temperature would be selected from a range preferably between about 33 degrees Fahrenheit and about 40 degrees Fahrenheit, but could be above 40 degrees Fahrenheit or below 33 degrees Fahrenheit if desired. A temperature should be selected so the ambient sensor responds before the temperature drops low enough to cause the water in the heating system to freeze. When the outside temperature or temperature in the heating zone drops below a predetermined temperature, the ambient sensor sends a signal to the processor, either initiating an alarm pathway or providing circulation mode for circulating water.

Other methods can be accomplished using various embodiments. One method includes detecting circulator failure by determining loss of circulator impeller using an air sensor and circulating water through the zone to be heated. Another method is monitoring temperature of the boiler heating coils and triggering the alarm pathway if the heating coil temperature deviates from a predetermined range known to those skilled in the art.

The examples provided herein are representative of preferred embodiments, are exemplary, and are not intended as limitations on the scope of the invention. It will be readily apparent to a person skilled in the art that varying substitutions and modifications may be made to the invention disclosed herein without departing from the scope and spirit of the invention. The invention illustratively described herein suitably may be practiced in the absence of any element or elements, limitation or limitations which are not specifically disclosed herein. Thus, for example, in each instance herein any of the terms "comprising", "consisting essentially of" and "consisting of" may be replaced with either of the other two terms. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

The processor, sensor, control board, relay and alarm arrangement discussed herein is merely exemplary and illustrative of apparatus and methods using inexpensive and readily-available components and hardware, and the illustrated examples are not limiting. Those skilled in the art will recognize various alternatives and options, including systems and setups that may involve one or more different types of processors, relays, control boards, connectors, cables, routers, hubs, sensors, etc., as well as setups that use other types of communication interfaces and/or controls, including interfaces and/or controls that may be more sophisticated and that can offer additional options.

Other embodiments are set forth within the following claims.

The invention claimed is:

1. A boiler and heating system protection apparatus comprising:

(a) a control board having at least one input and at least one output;

(b) a processor having at least one input and at least one output;

(c) at least one ambient sensor located inside an enclosure to be heated by a heating system or in a heating zone of the heating system, said ambient sensor being in communication with the processor through the at least one input wherein said ambient sensor is capable of detecting ambient temperature inside the enclosure;

(d) at least one boiler sensor located between one or more boiler sections of a boiler, said boiler sensor being in communication with the processor through the at least one input wherein said boiler sensor is capable of detecting boiler core temperature in the boiler sections;

(e) an alarm relay connected to the control board by the at least one output and which is capable of sending notification to an alarm system;

(f) a power failure relay, said power failure relay being in communication with the processor through the at least one input wherein said power failure relay is capable of detecting power failure of the boiler;

wherein when a temperature detection event occurs the boiler sensor communicates with the processor and initiates an alarm pathway to prevent damage to the boiler sections and heating system due to extreme temperatures in the boiler sections;

wherein when a heating system malfunction occurs the power failure relay or the boiler sensor communicates with the processor and initiates an alarm pathway to prevent or minimize damage to the boiler and heating system.

2. The apparatus of claim 1 wherein the ambient temperature detection event is a drop in ambient temperature to between about 33 degrees Fahrenheit and about 40 degrees Fahrenheit and wherein the temperature detection event is a drop in temperature to between about 33 degrees Fahrenheit and about 40 degrees Fahrenheit.

3. The apparatus of claim 1 further comprising a boiler in communication with the control board, wherein the heating system malfunction is boiler failure.

4. The apparatus of claim 3 wherein the boiler failure is detected by monitoring power to the boiler using the power failure relay.

5. The apparatus of claim 1 further comprising a circulator motor operatively connected to the boiler, wherein the heating system malfunction is circulator failure.

6. The apparatus of claim 5 further comprising at least one overcurrent/undercurrent sensor wherein said overcurrent/undercurrent sensor detects circulator failure by monitoring current transformers of at least one circulator motor to determine whether the circulator is drawing too much current or too little current.

7. A boiler and heating system protection apparatus comprising:

(a) a control board having at least one input and at least one output;

(b) a processor having at least one input and at least one output;

(c) at least one ambient sensor located inside an enclosure to be heated by a heating system or in a heating zone of the heating system, said ambient sensor being in communication with the processor through the at least one input wherein said ambient sensor is capable of detecting ambient temperature inside the enclosure;

(d) at least one boiler sensor located between one or more boiler sections of a boiler, said boiler sensor being in communication with the processor through the at least one input wherein said boiler sensor is capable of detecting boiler core temperature in the boiler sections and boiler water level;

wherein when there is a heating system malfunction the power failure relay or the boiler sensor communicates with the processor, which provides a circulation mode for circulating water through a heating system of an enclosure to be heated by the boiler to prevent or minimize damage to the boiler and heating system.

8. The apparatus of claim 7 wherein the ambient temperature detection event is a drop in ambient temperature to between about 33 degrees Fahrenheit and about 40 degrees Fahrenheit and wherein the temperature detection event is a drop in temperature to between about 33 degrees Fahrenheit and about 40 degrees Fahrenheit.

9. The apparatus of claim 7 further comprising a boiler in communication with the control board wherein the heating system malfunction is low water level in the boiler and the boiler sensor detects said low water level.

10. The apparatus of claim 7 wherein the heating system malfunction is boiler failure and wherein the boiler failure is detected by monitoring power to the boiler using the power failure relay and the apparatus restores power to the boiler from an alternative power source.

11. The apparatus of claim 7 further comprising a boiler and a circulator motor operatively connected to the boiler, at least one overcurrent/undercurrent sensor wherein the heating system malfunction is circulator failure, and wherein said overcurrent/undercurrent sensor detects circulator failure by monitoring current transformers of at least one circulator to determine whether the circulator is drawing too much current or too little current.

12. The apparatus of claim 7 further comprising at least one hydro air sensor wherein the hydro air sensor detects circulator failure by determining loss of a circulator impeller.

13. The apparatus of claim 7 further comprising an overcurrent/undercurrent sensor wherein said overcurrent/undercurrent sensor monitors hydro air blower motor current to detect hydro air blower motor failure.

14. The apparatus of claim 7 further comprising a hydro air sensor wherein said hydro air sensor detects circulator failure of one or more circulator motors by monitoring hydro air cabinet temperature or temperature of an enclosure to be heated by the boiler and heating system.

15. A method of protecting a boiler and heating system from damage comprising:

(a) detecting the occurrence of an ambient temperature detection event using at least one ambient sensor located inside an enclosure to be heated by a heating system or in a heating zone of the heating system;

(b) detecting the occurrence of a temperature detection event using at least one boiler sensor located between one or more boiler sections;

(c) detecting the occurrence of a heating system malfunction using the boiler sensor or a power failure relay;

(d) initiating an alarm pathway using an alarm relay;

wherein when a temperature detection event occurs the boiler sensor communicates with a processor and initiates the alarm pathway to prevent damage to the boiler sections and heating system due to extreme temperatures in the boiler sections;

wherein when there is a heating system malfunction the power failure relay or the boiler sensor communicates with the processor, which initiates the alarm pathway to prevent or minimize damage to the boiler or heating system.

16. The method of claim 15 wherein the ambient temperature detection event is a drop in ambient temperature to between about 33 degrees Fahrenheit and about 40 degrees Fahrenheit and wherein the temperature detection event is a drop in temperature to between about 33 degrees Fahrenheit and about 40 degrees Fahrenheit.

17. The method of claim 15 wherein the heating system malfunction is low water level in the boiler and the boiler sensor detects said low water level.

18. A method of protecting a boiler and heating system from damage comprising:

(a) detecting the occurrence of an ambient temperature detection event using at least one ambient sensor located inside an enclosure to be heated by a heating system or in a heating zone of the heating system;

(b) detecting the occurrence of a temperature detection event using at least one boiler sensor located between one or more boiler sections;

(c) detecting the occurrence of a heating system malfunction using a boiler sensor and a power failure relay; wherein when a temperature detection event occurs the boiler sensor communicates with a processor and initiates an alarm pathway to prevent or minimize damage to the boiler sections and heating system due to extreme temperatures in the boiler sections; wherein when there is a heating system malfunction the power relay or the boiler sensor communicates with the processor, which initiates the alarm pathway to prevent or minimize damage to the boiler or heating system.

19. The method of claim 18 wherein the heating system malfunction is circulator failure.

20. The method of claim 18 wherein the heating system malfunction is boiler failure.

21. The method of claim 18 wherein the heating system malfunction is low water level in the boiler and the boiler sensor detects said low water level.

22. A method of protecting a boiler and heating system from damage comprising:

detecting the occurrence of an ambient temperature detection event using at least one ambient sensor located outside an enclosure to be heated by a heating system or in a heating zone of the heating system;

detecting the occurrence of a temperature detection event using at least one boiler sensor located between one or more boiler sections;

detecting the occurrence of a heating system malfunction using a boiler sensor and a power failure relay;

detecting circulator failure using at least one overcurrent/undercurrent sensor wherein said overcurrent/undercurrent sensor monitors current transformers of at least one circulator motor to determine whether the circulator is drawing too much current or too little current;

wherein when the overcurrent/undercurrent sensor detects circulator failure, said overcurrent/undercurrent sensor communicates with a processor and initiates an alarm pathway.

23. The method of claim 22 further comprising a hydro air sensor wherein said hydro air sensor detects circulator failure of one or more circulator motors by monitoring hydro air cabinet temperature or temperature of an enclosure to be heated.

24. The method of claim 22 further comprising at least one hydro air sensor wherein the hydro air sensor detects circulator failure by determining loss of a circulator impeller.

25. The method of claim 22 circulator failure is detected by monitoring relay power of heating system circulators.

* * * * *